United States Patent [19]

Christiansen

[11] 4,332,338

[45] Jun. 1, 1982

[54] WALLET WITH ELASTIC STRAP

[76] Inventor: James S. Christiansen, 5288 Austin Rd., Santa Barbara, Calif. 92111

[21] Appl. No.: 209,759

[22] Filed: Nov. 24, 1980

[51] Int. Cl.[3] ..... A45C 1/06

[52] U.S. Cl. ..... 224/222; 150/38

[58] Field of Search ..... 224/219, 222, 229, 901; 150/35, 38

[56] References Cited

U.S. PATENT DOCUMENTS

| | | | |
|---|---|---|---|
| 710,732 | 10/1902 | Anderson | 224/222 |
| 1,972,480 | 9/1934 | Gomi | 224/222 |
| 3,543,977 | 12/1970 | Lockridge | 224/901 X |
| 4,055,873 | 11/1977 | Kallman | 224/901 X |
| 4,209,048 | 6/1980 | Sandos | 150/38 |

*Primary Examiner*—Steven M. Pollard

*Attorney, Agent, or Firm*—Charles H. Thomas

[57] ABSTRACT

A wallet is formed of inner and outer sheets of flexible material stitched together about three edges to define a paper currency receiving pocket. An elongate elastic strap has one end anchored near one transverse edge of the wallet and the opposite end of the strap passes between the flexible sheets of material and protrudes therefrom at the opposite transverse edge. The free end of the strap bears a pad with a multiplicity of minute hooks projecting therefrom. A corresponding pad has a fine, looped pile and is located on the outer surface of the wallet at the transverse edge at which the strap is secured. The two pads are mutually engageable both when the wallet is in a folded disposition for insertion into a trouser or coat pocket, and also when the wallet is unfolded and the strap extended to encircle the arm or leg of a user. The user is thereby able to carry the wallet secured about his or her limb while engaging in vigorous activity such as jogging or swimming.

3 Claims, 5 Drawing Figures

WALLET WITH ELASTIC STRAP

BACKGROUND OF THE INVENTION

1. Field of the Invention

The present invention relates to wallets and billfolds.

2. Description of the Prior Art

Flexible wallets are currently available which have flaps of mutually engageable members that hold the wallet folded shut when desired, but which are also releasable. Such wallets typically employ mating pads of releasably engageable material. One pad bears a multiplicity of minute hooks projecting outwardly therefrom and the other pad bears a fine, looped pile which is releasably engageable with the hooks. Both portions of such a set of pads are sold under the registered trademark "VELCRO".

Conventional wallets, however, all depend upon the availability of a garment pocket or a purse for ease in carrying. Men typically carry wallets in their trouser or coat pockets, while women usually carry wallets in their purses. However, wallets are normally not carried by individuals engaged in activities in which garments without suitable pockets are appropriate, and where purses are cumbersome to carry or inappropriate. For example, jogging suits normally do not have pockets suitable for carrying wallets, and to carry a purse while jogging would be a considerable nuisance. Similarly, swimming suits, wet suits, tennis shorts and various other special purpose garb, typically designed for use in vigorous activity, do not have pockets suitable for carrying a wallet. As a result, individuals have heretofore have been unable to carry their wallets while engaged in such activity. This has resulted in considerable inconvenience since individuals are thereby left without change for telephone calls or paper currency for purchases of refreshments and the like. Moreover, wallets left on beach blankets and towels are sometimes lost, or stolen. Also, wallets left in locker rooms are subject to the considerable hazzard of locker room theft.

SUMMARY OF THE INVENTION

According to the present invention a wallet is constructed of flexible material, such as nylon, and is provided with an elongate elastic strap. The wallet is formed of at least inner and outer sheets of flexible material which define a currency receiving pocket therebetween. The flexible sheets are secured to each other to define opposing longitudinal and opposing transverse edges. One end of the elastic strap is anchored interiorally from one transverse edge of the wallet and passes through the structure of the wallet to protrude from the opposite transverse edge. A pair of mating, releasably engageable pads are also provided. One of the pads bears a multiplicity of minute hooks projecting therefrom and the other pad bears a fine, looped pile which is releasably engageable with the hooks of the first pad. One of the pads is secured to the free end of the elongate, elastic strap, and the other pad is secured to the outside surface of the outer sheet of material of the wallet, preferably at the transverse edge near which the strap is secured.

The wallet can be folded in a conventional fashion with the pads on the outer surface of the wallet and on the free end of the strap in mutual engagement. The strap in its unextended disposition is short enough to hold the wallet folded shut. However, the wallet can also be unfolded and laid spread open against an individuals arm or leg. The elastic strap is extended to encircle the user's limb. The mating pads are engaged and the individual is free to jog, swim or engage in other vigorous activity while maintaining the wallet in his or her possession.

Another advantage of the wallet of the invention is that it may be used to safeguard a person's money from pickpockets and muggers. Unlike money belts and other prior art devices designed for this purpose, the wallet of the invention is designed to be readily attached to and removeable from the limb of an individual. The wallet can be concealed from view, but is readily removeable and is not entrapped beneath clothing, and is thereby conveniently available when required.

The invention may be described with greater clarity and particularly by reference to the accompanying drawings.

DESCRIPTION OF THE EMBODIMENT

Figure 4:
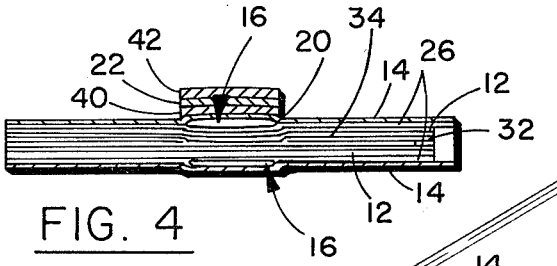
FIG. 4 is a sectional view illustrating the wallet folded shut and latched and taken along the lines 4—4 of FIG. 2.
Figure 1:
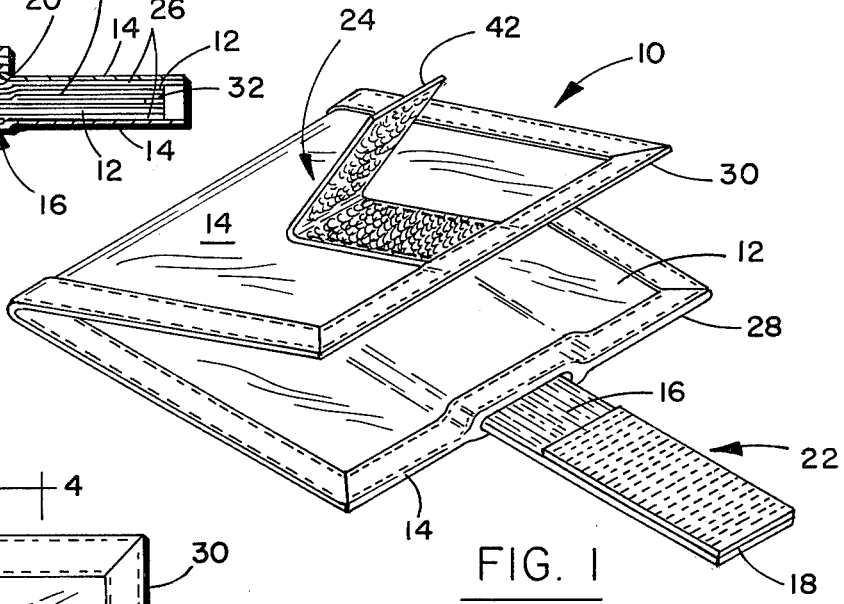
FIG. 1 is a perspective view of the wallet of the invention.

A wallet 10 according to the invention includes both an inner sheet 12 and an outer sheet 14 of flexible material, such as nylon fabric, secured together to define a currency receiving pocket therebetween. An elongate elastic strap 16 has a free end 18 and an anchored end 20 secured to said sheet of material 14, preferably interiorally from one transverse edge 30. The strap 16 passes internally between the sheets of material, as illustrated in FIGS. 1 and 4, with the free end 18 protruding from between the inner and outer sheets 12 and 14 at an opposite transverse edge 28. A pair of mating releasably engageable pads 22 and 24 are provided. The pad 22 bears a multiplicity of minute hooks projecting outwardly therefrom and the pad 24 bears a fine, looped pile releasably engageable with the hooks of the pad 22. Mating pads such as these are both sold under the registered trademark "VELCRO". The pad 22 is secured to the free end 18 of the elongate elastic strap 16 and the pad 24 is secured to the outer sheet 14 of flexible material adjacent the transverse edge 30, by stitching. One line of stitching 24' passes through the outer sheet 14 and secures the anchored end 20 of the strap 16 thereto in immovable secure fashion.

The wallet 10 is formed with a liner or backing 26 which is visible in FIG. 4. Both the liner 26 and the outer flexible sheet 14 are cut in congruent rectangular configurations and sewn together by double lines of stitching around their entire perimeters, as illustrated in FIG. 3, with the exception of that area in the transverse edge 28 through which the free end 18 of the elongate strap 16 passes.

The inner flexible sheet of material 12 faces the liner 26 to define the billfold pocket which has an opening at the longitudinal edge 36. The sheets 12 and 14 are sewn together on both transverse edges 28 and 30 and the opposing longitudinal edge 38. The strap 16 does not pass through the billfold pocket, but rather behind the pocket, between the liner 26 and the outer sheet 14.

Figure 3:
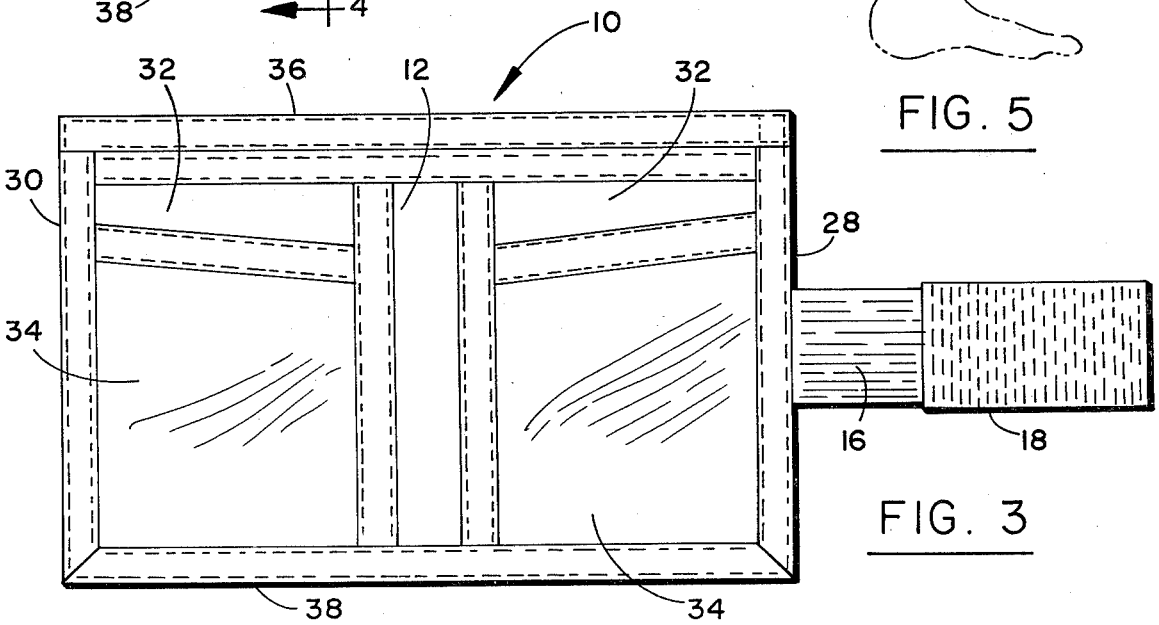
FIG. 3 is a plan view of the inside of the wallet of the invention spread open.

To the inner face of the inner sheet 12 there are pairs of smaller rectangular shaped sheets of nylon fabric 32 and 34 secured by stitching to define additional, smaller pockets in the wallet 10, as illustrated in FIG. 3. Pockets are defined between each of the facing sheets 32 and 34 and between each sheet 32 and the inner sheet of material 12 on each side of the transverse center fold of the wallet. Change, credit cards and the like can be carried in these pockets, while paper currency is typically carried in the pocket defined between the liner 26 and the inner sheet of material 12.

Figure 5:
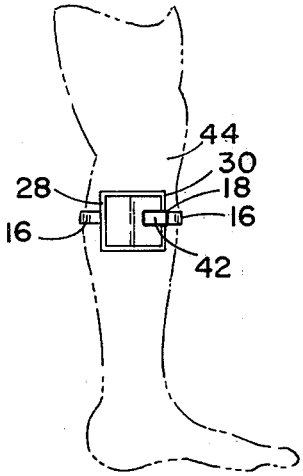
FIG. 5 illustrates the wallet of the invention about the leg of an individual.

The various sheets of material used in the construction of the wallet 10 are fastened together by reinforcing borders through which lines of double stitching pass, as depicted in FIG. 3. It is to be understood that the line of double stitching visible in FIG. 3 at the transverse edge 28 does not pass through the elastic strap 16, but rather merely fastens the adjacent sheets 32 and 34 together at the center of the edge 28. Overstitching secures the nylon sheets 14, 26, 12, 32 and 34 together along the transverse edge 28 on either side of the strap 16. The elongate strap 16 is thereby free to move longitudinally parallel to the opposing longitudinal edges 36 and 38 of the wallet 10. This enables the strap 16 to be extended fully so that it can be positioned about the arm or leg of an individual as illustrated in FIG. 5.

Figure 2:
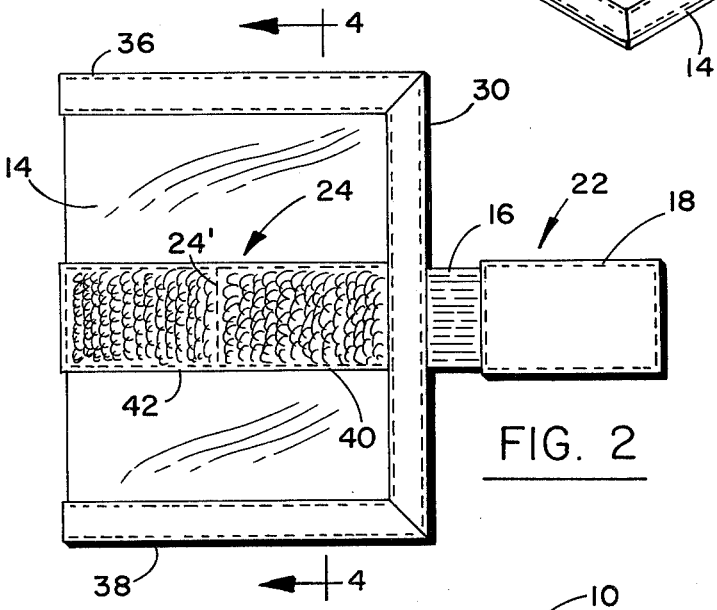
FIG. 2 is a plan view of the outside of the wallet of the invention folded shut.

The inner and outer nylon sheets 12 and 14 are secured together along both transverse edges 28 and 30, except at the center of the edge 28 through which the strap 16 passes. The anchored end 20 of the strap 16 is secured beneath the underside of the outer sheet 14 by the line of stitching 24' near the transverse edge 30, as depicted in FIG. 2 and FIG. 4. The pad 24 is secured to the outside surface of the outer sheet 14 at this same transverse edge 30. The strap 16 protrudes from between the inner and outer sheets 12 and 14 at the opposite transverse edge 28 as depicted in FIGS. 1 and 3.

The pad 24 secured to the outer sheet of material 14 at the transverse edge 30 has one rectangular portion 40 immovably fastened to the outer surface of the outer sheet 14 by a rectangular line of stitching about its perimeter. A second portion 42 of the pad 24 is held as a flap secured to the portion 40 remote from the transverse edge 30 and is rotatable into facing relationship relative to the portion 40. In this way a pair of facing surfaces are defined by the pad 24, both bearing the fine looped pile.

The pad 22 is a double sided pad, having a multiplicity of minute hooks projecting outwardly therefrom on both sides. When the pad 22, on the free end 18 of the strap 16 is inserted between the portions 40 and 42 of the pad 24, a pair of parallel interfaces are defined therebetween at which the multiplicity of hooks on both sides of the pad 22 tenaciously grip the pile of the pad portions 40 and 42 of the pad 24.

With reference to FIG. 2, the wallet 10 may be folded in half to be conveniently carried in a garment pocket or a purse. When the wallet 10 is folded as illustrated, the elastic strap 16 resides in its relaxed unextended position and the free end 18 of the strap 16 may be folded over the folded transverse edges 28 and 30 of the wallet 10 to engage the immobile portion 40 of the pad 24. Thereupon, the rotatable portion 42 of the pad 24 is rotated downwardly to entrap the pad 22 therebetween in sandwich fashion, as depicted in FIG. 4. The strap 16 in its relaxed position is short enough to hold the wallet folded shut as indicated in FIGS. 2 and 4.

Alternatively, the wallet 10 may be unfolded as depicted in FIG. 3, spread open and laid with the inner nylon sheet 12 and the smaller nylon sheets 32 and 34 facing the skin of the leg 44 of the user, as depicted in FIG. 5. While holding the wallet 10 open against the leg 44, the user pulls on the elastic strap 16 to extend it and encircle the leg 44. As the end 18 is stretched to reach beyond the transverse edge 30 about the leg 44, the pad 22 is placed in contact with the portion 40 of the pad 24, whereupon it becomes engaged therewith. The portion 42 of the pad 24 is folded over the pad 22 to effectuate releasable engagement between both sides of the pad 22 and the facing surfaces of the portions 40 and 42 of pad 24. The individual is thereby able to engage in very vigorous, physical activity, and the wallet 10 will remain safely in position on the leg 44. When the user desires to remove the wallet 10 from his leg 44, the portion 42 of the pad 24 is first peeled back to expose the pad 22. The pad 22 is thereupon peeled away from the portion 40 of the pad 24 to release the free end 18 of the strap 16.

It is to be understood that numerous variations and modifications to the embodiment of the invention depicted are possible. For example the pad 24 might be replaced by a pad having a single portion attached to the outer sheet 14 and a pad with a single engagable side might be sustituted for the pad 22. Accordingly, the scope of the invention should not be construed as limited to the specific embodiment depicted, but rather is defined in the claims appended hereto.

I claim:

1. A wallet formed of inner and outer sheets of flexible material both having opposite longitudinal edges and opposite transverse edges, and said inner and outer sheets are permanently secured together at one longitudinal edge and both opposite transverse edges to define a currency receiving pocket open at the unsecured longitudinal edges of said inner and outer sheets, a pocket liner located between said inner and outer sheets and having opposite longitudinal and opposite transverse edges, and said pocket liner is permanently secured to said outer sheet of flexible material, an elongate elastic strap having one free end and one anchored end secured to said outer sheet of material and said strap passes freely behind said currency receiving pocket internally between said outer sheet of material and said pocket liner so that the portion thereof behind said currency receiving pocket is freely stretchable and retractable, and said free end of said strap protrudes from between said outer sheet of material and said pocket liner between locations at which said pocket liner and said outer sheet of material are secured together, and mating pads, one of which bears a multiplicity of minute hooks projecting therefrom and the other of which bears a fine, looped pile releasably engageable with said hooks, and one of said pads is secured to said free end of said elongate strap, and the other of said pads is secured to said outer sheet of flexible material.

2. A wallet according to claim 1 further characterized in that said sheets of material are of rectangular configuration and said anchored end of said strap is secured to said outer sheet at the underside thereof interiorally from one of said transverse edges, and said pad thereon is secured to the outside surface of said outer sheet at the same transverse edge and said strap protrudes from between said inner and outer sheets and from between said outer sheet and said pocket liner at said opposite transverse edge.

3. A wallet according to claim 2 further characterized in that said pad secured to said one transverse edge of said outer sheet of material has one portion immovably fastened to said outer surface and another portion held as a flap secured to said one portion remote from said one transverse edge and rotatable into facing relationship relative to said one portion of said pad, and said pad secured to said free end of said strap is double sided.

* * * * *